United States Patent [19]

Haswell et al.

[11] 4,276,087

[45] Jun. 30, 1981

[54] POWDER-METALLURGY VANADIUM-CONTAINING TUNGSTEN-TYPE HIGH-SPEED STEEL

[75] Inventors: Walter T. Haswell, Jamesville, N.Y.; William Stasko, Munhall; F. Robert Dax, Pittsburgh, both of Pa.

[73] Assignee: Crucible Inc., Pittsburgh, Pa.

[21] Appl. No.: 35,652

[22] Filed: May 3, 1979

[51] Int. Cl.[3] ..... C22C 1/04

[52] U.S. Cl. ..... 75/243; 75/126 E; 75/126 H

[58] Field of Search ..... 75/126 E, 126 H, 243

[56] References Cited

U.S. PATENT DOCUMENTS

| | | | |
|---|---|---|---|
| 3,561,934 | 2/1971 | Steven | 75/243 |
| 4,036,640 | 7/1977 | Philip et al. | 75/126 E |

FOREIGN PATENT DOCUMENTS 781083 8/1957 United Kingdom .

*Primary Examiner*—M. J. Andrews
*Attorney, Agent, or Firm*—Clair X. Mullen, Jr.

[57] ABSTRACT

A powder-metallurgy produced, vanadium-containing, tungsten-type high-speed steel wherein hardness at elevated temperature is achieved without resorting to conventional, high cobalt contents. This is achieved by providing a critical amount of tungsten and/or molybdenum above that conventionally used in combination with vanadium and carbon in an amount sufficient to combine with the vanadium present and with an excess carbon to provide matrix strengthening. The high hardness and wear resistance at elevated temperature is imparted to the steel by the carbides of vanadium, tungsten and/or molybdenum. Columbium may be substituted for a portion of the vanadium.

6 Claims, 4 Drawing Figures

POWDER-METALLURGY VANADIUM-CONTAINING TUNGSTEN-TYPE HIGH-SPEED STEEL

In high speed cutting applications wherein superior hardness and wear resistance are required at elevated temperature, it is customary to provide steels having high cobalt content. More specifically, for this purpose, cobalt contents on the order of 5%, and as high as 12%, are customarily employed. For wear resistance vanadium is also present, typically from about 1 to 5%. The vanadium carbides provide the desired wear resistance, even at extremely high temperatures, and the cobalt contributes significantly to the hardness at these extremely high temperatures.

Cobalt, which has typically been a relatively expensive alloying addition, has more recently increased more than five-fold in cost, thereby significantly increasing the cost of high-speed steels requiring high cobalt for elevated-temperature properties.

It is accordingly the primary object of the present invention to provide a powder-metallurgy produced, high-speed steel that contains either no cobalt or relatively low cobalt and yet is characterized by hardness and wear resistance at extremely high operating temperatures similar to or superior to conventional alloys containing typical amounts of cobalt of for example 5 and 8%.

This and other objects of the invention as well as a more complete understanding thereof may be obtained from the following description, specific examples and drawings, in which.

Figure 1:
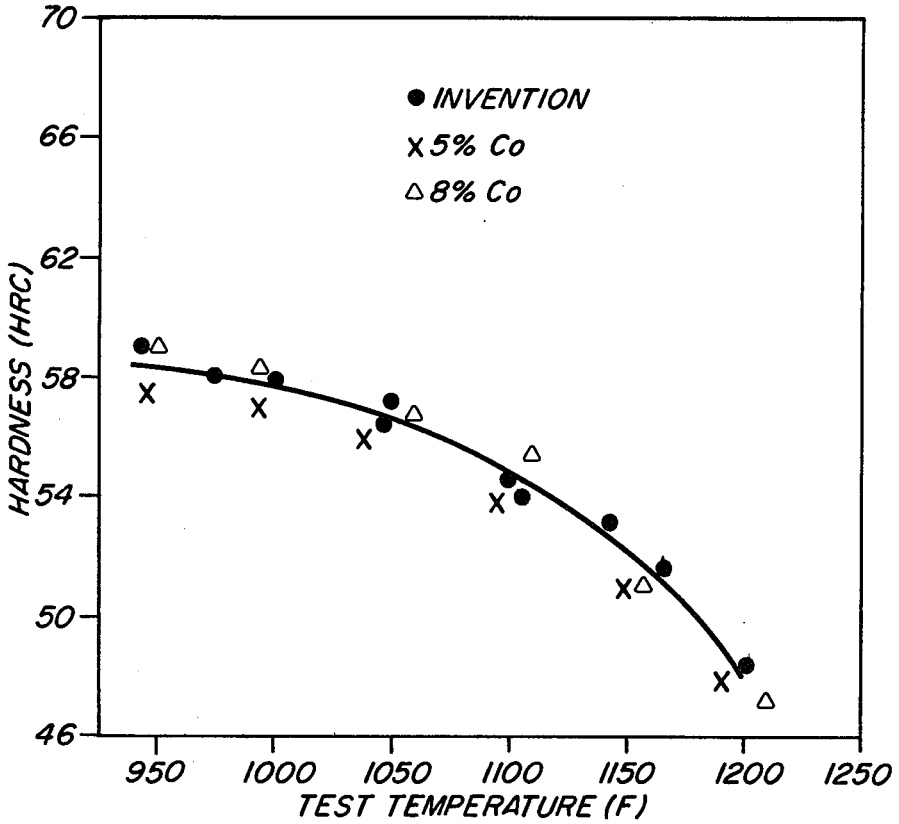
FIG. 1 shows the hot hardness characteristics of a steel of the invention in comparison with conventional 5 and 8% cobalt-containing steels.

Broadly, in the practice of the present invention it has been found that by increasing the "tungsten equivalency" of a high-speed steel, containing about 1 to 6% vanadium, to higher than conventional levels it is possible to achieve attainable hardnesses and hot hardnesses characteristic of otherwise similar alloys containing nominally 5 and 8% cobalt. An illustration of this hot hardness characteristic of a steel of this invention is shown in FIG. 1 which compares its elevated temperature hardness to that of commercially-available 5 and 8% cobalt-containing super-high speed tool steels (CPM T15 and CPM M42, respectively). Hot hardness determinations were made on a Rockwell hardness tester that had been modified for use at elevated temperature by the addition of an inert-atmosphere-containing furnace and an extended length, diamond-tipped indenter. The furnace is mounted on a cross slide that permits precise location of the hardness indentations on the specimen. An external indicating device marks the location of prior indentations on the specimen on an image paper to eliminate interference among the different indentations. The test temperature is measured with a thermocouple spotwelded to the specimen surface. The specimen hardness is taken at room temperature with the extended indenter in the high-temperature assembly and compared to hardness readings obtained on the same specimen using the normal test set-up in another hardness tester. If agreement of 0.5 HRC is obtained between the readings taken on the two testers, the furnace is activated and the specimen heated to the lowest of the specified elevated temperatures. The specimen is soaked at temperature for 15 minutes, five hardness readings are taken, the specimen is heated to the next desired test temperature and the procedure is repeated. In FIG. 1, the resultant average HRC readings for the steel of this invention and the commercially available 5 and 8% cobalt-containing steels show that all three steels have comparable elevated-temperature hardness characteristics. If additional elevated-temperature hardness is desired, an optional addition of cobalt up to a maximum of 3% may be used. In addition, strengthening is achieved by having matrix carbon present in an amount in excess of that required to combine with the vanadium. Although it is known to use tungsten and/or molybdenum in high speed steels the effect thereof has been to combine with the carbon present to form carbides of these elements. On the other hand, cobalt affects the alloy, specifically the hardness thereof at elevated temperatures, e.g. hot or red hardness, by a different mechanism. Hence, although both tungsten and/or molybdenum, and cobalt are known for use in high-speed steels, it is heretofore not been appreciated that tungsten and/or molybdenum may be substituted for cobalt from the standpoint of providing red hardness in high speed steels.

Further, with respect to the invention the broad composition in accordance therewith is, in weight percent, carbon minimum$0.60+0.20\times$percent vanadium and maximum$1.2+0.20\times$percent vanadium, manganese 1.25 max., silicon 1.25 max., chromium 3 to 5, tungsten equivalent 22 to 29 preferably 24 to 27, vanadium about 0.8 to 6, and the balance iron. A preferred composition is, in weight percent, carbon minimum$0.60+0.20\times$percent vanadium and maximum$1.2+0.20\times$percent vanadium, manganese 1.25 max., silicon 1.25 max., chromium 3 to 5, tungsten equivalent 22 to 29, preferably 24 to 27, vanadium 3 to 6, and the balance iron. The alloys according to the invention have an attainable hardness of at least 67 $R_c$ when austenitized and triple tempered at 1025° F. In addition, cobalt may be present up to 3%, and up to 4% columbium may be present with the sum of vanadium and columbium not exceeding 6%. When columbium is included in the alloy, a carbon balance factor of$0.13\times$percent columbium is used.

By way of specific example and demonstration of the invention the compositions listed in Table I were produced and tested with respect to hardness as set forth in Table I.

TABLE I

| Grade or Heat No. | Chemical Composition (Wt. %) C | Mn | Si | Cr | W | Mo | V | Co | C Adjusted for 5% V Level | W Equivalent | As-heat Treated* (A) | Hardness HRC (A) + 1200° F./2 hr. | (A) + 1200° F./2 + 2 hr. |
|---|---|---|---|---|---|---|---|---|---|---|---|---|---|
| IL34 | 1.57 | .35 | .35 | 4.02 | 12.14 | 0.01 | 5.66 | — | 1.44 | 12.15 | 65 | 60 | 57 |
| IL35 | 1.75 | .32 | .32 | 3.99 | 11.80 | 1.54 | 5.37 | — | 1.68 | 14.88 | 67.5 | 61 | 58 |
| IL36 | 1.74 | .29 | .29 | 4.00 | 11.80 | 5.57 | 5.29 | — | 1.68 | 22.94 | 67.5 | 61.5 | 58 |
| IL37 | 1.90 | .25 | .25 | 3.89 | 11.63 | 8.24 | 5.07 | — | 1.89 | 28.11 | 69 | 63 | 60 |
| IL39 | 1.75 | .73 | 1.03 | 4.08 | 11.52 | 3.18 | 5.24 | — | 1.70 | 17.88 | 67.5 | 61.5 | 57 |
| IL41 | 1.71 | .41 | .34 | 4.14 | 11.90 | 6.52 | 5.43 | — | 1.63 | 24.94 | 67 | 61 | 57.5 |
| IL42 | 1.79 | .39 | .33 | 4.11 | 11.87 | 6.50 | 5.33 | — | 1.72 | 24.87 | 68.5 | 62.5 | 59.5 |
| IL43 | 1.86 | .40 | .30 | 4.24 | 13.03 | 6.63 | 5.86 | — | 1.69 | 26.29 | 68.5 | 63.5 | 60.5 |
| IL44 | 1.97 | .38 | .30 | 4.14 | 12.16 | 6.47 | 5.42 | — | 1.89 | 25.10 | 67.5 | 64.5 | 62 |
| IL45 | 1.84 | .43 | .33 | 4.17 | 12.18 | 7.57 | 5.76 | — | 1.69 | 27.32 | 68 | 60.5 | 58 |
| IL46 | 1.86 | .42 | .33 | 4.17 | 12.23 | 7.57 | 5.75 | — | 1.71 | 27.37 | 68.5 | 61.5 | 59 |
| IL47 | 1.86 | .45 | .32 | 4.14 | 12.23 | 8.53 | 5.66 | — | 1.73 | 29.29 | 69 | 63 | 60 |
| CPM T15 | 1.58 | — | .34 | 4.12 | 12.0 | 0.59 | 5.0 | 4.92 | 1.58 | 13.18 | 67.5 | 61.5 | 58 |
| REX 25 | 1.81 | .30 | .35 | 4.05 | 12.56 | 6.52 | 5.04 | — | 1.80 | 25.60 | 68 | 62.5 | 58.5 |

*Austenitized at 2250° F./4 min., OQ, tempered at 1025° F./2 + 2 + 2 hr.

Although the steels of the invention have an attainable hardness of at least 67 $R_c$ when austenitized and triple tempered at 1025° F., it is understood that nevertheless other heat treatments may be used with respect to the steels.

The term "tungsten equivalent" as used herein refers to the tungsten content plus twice the molybdenum content, in that the effect produced by tungsten is duplicated by half as much molybdenum. The matrix carbon content is the percent carbon present in excess of that needed to react with the vanadium and columbium, and other primary carbide forming elements, to produce carbides. Approximately 0.2% carbon is required for this purpose for each 1% vanadium present in the alloy, and consequently the carbon content is defined by the formulae minimum0.60%C+0.20×percent vanadium and maximum1.2%C+0.20×percent vanadium.

Figure 2:
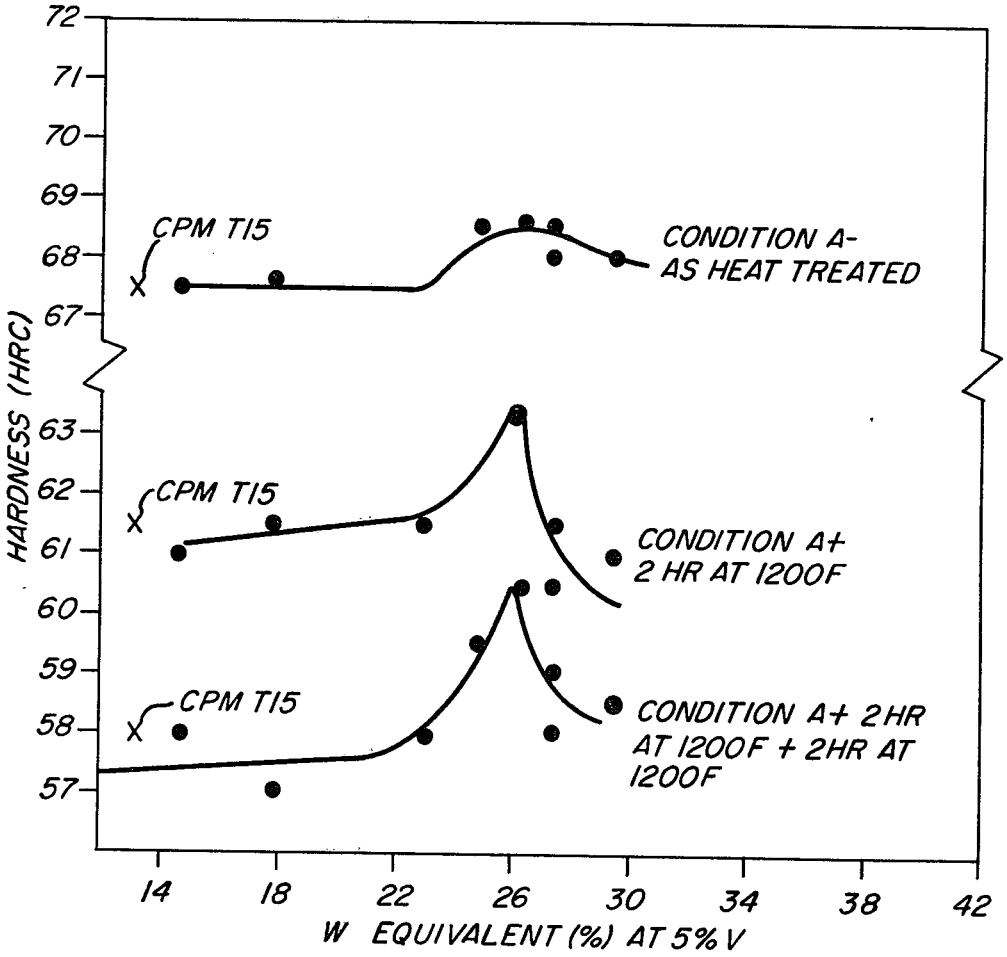
FIG. 2 is a graph showing the effect of varying tungsten equivalents on hardness.
Figure 3:
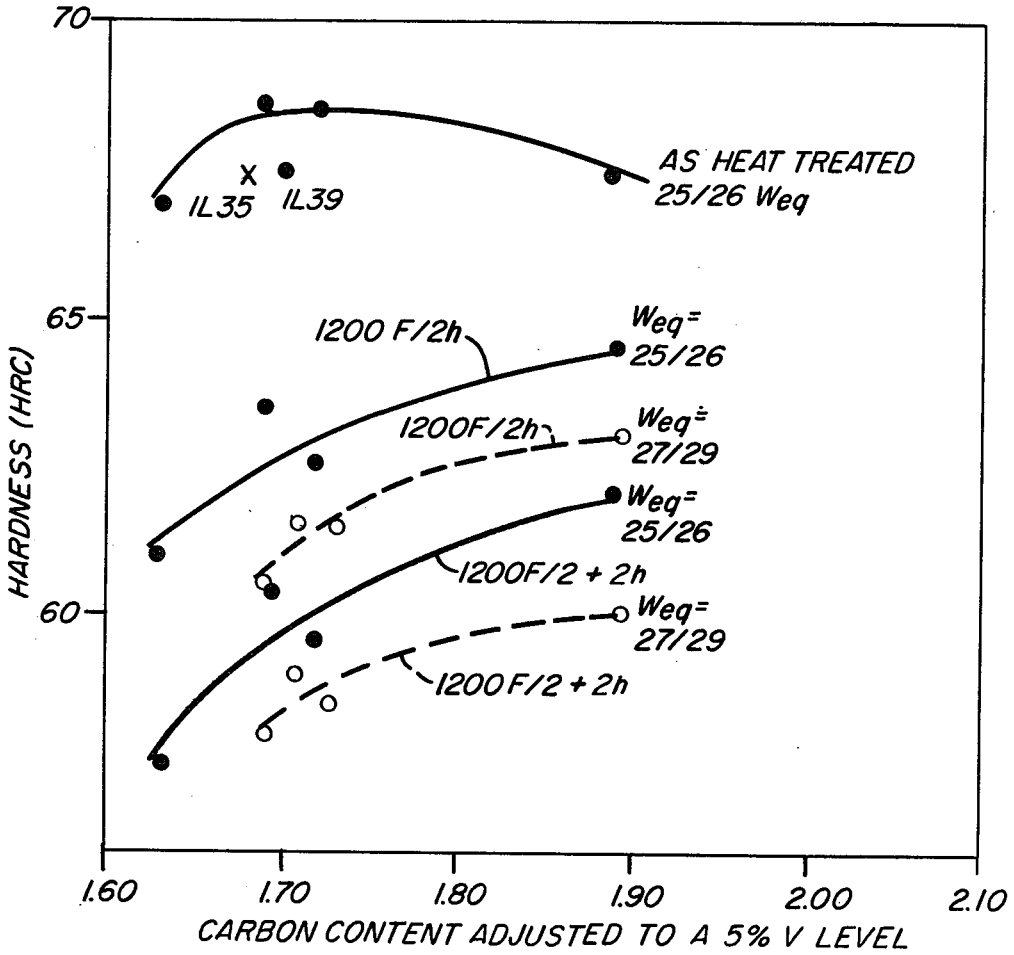
FIG. 3 is a graph showing the effect of carbon content on hardness at various tungsten equivalency levels.

As may be seen from the data in Table I and FIG. 2 of the drawings, which relate to the attainable hardness and hardness after one two-hour exposure at 1200° F. and a second two-hour exposure at 1200° F., the as-heat treated hardness for alloys in accordance with the invention, namely IL36, IL42, IL43 and IL46 and IL47, are comparable to or slightly higher than that of the conventional T15 alloy containing nominally 5% cobalt. To analyse the effect of tungsten equivalency on the hardness characteristics, it was necessary to compensate for the effect of variations in vanadium content above our 5% vanadium aim and in the high vanadium versions of the alloys of this invention by adjusting the actual carbon contents by a factor of 0.2 (V content −5%). Table I contains the adjusted carbon information used in constructing FIGS. 2 and 3. The alloys of this invention which consistently show hardness characteristics comparable to T15 alloy containing 5% cobalt are those which are cobalt-free and have tungsten equivalents ranging from 22 to 29% in accordance with the invention. Also, there is no cobalt present in these alloys. It should be noted, however, that with alloys IL35 and IL39 having tungsten equivalents of 14.88% and 17.88%, respectively, the hardness values as represented on FIG. 2 were inferior to those of the aforementioned alloys within the scope of the invention. All of the alloys plotted, except CPM T15, had adjusted carbon equivalents within the range of 1.68 to 1.73%. Similar results are shown in FIG. 3 wherein the carbon equivalent was adjusted to a 5% vanadium level. Again, alloys such as IL42 and IL43 having tungsten equivalents within the scope of the invention showed superior attainable hardness and hardness retention over alloys IL35 and IL39 having tungsten equivalents of approximately 15 and 18%, respectively, and being outside the scope of the invention. It appears, therefore, that the effect of tungsten equivalency with regard to attainable hardness is effective at various carbon equivalency levels within the scope of the invention.

TABLE II

| Grade or Heat No. | Chemical Composition (Wt. %) C | Mn | Si | Cr | W | Mo | V | Cb | Co | C Adjusted for 1% V | W Equivalent | As-heat Treated* (A) | Hardness HRC (A) + 1200° F./2 hr. | (A) + 1200° F./2 + 2 hr. |
|---|---|---|---|---|---|---|---|---|---|---|---|---|---|---|
| IL49 | 1.17 | .32 | .16 | 3.77 | 1.39 | 9.75 | 1.16 | — | — | 1.14 | 20.89 | 66.5 | 56 | 52.5 |
| IL50 | 1.18 | .28 | .13 | 3.74 | 3.23 | 9.72 | 1.13 | — | — | 1.15 | 22.67 | 66.5 | 56.5 | 51.5 |
| IL51 | 1.17 | .23 | .10 | 3.65 | 6.03 | 9.65 | 1.10 | — | — | 1.15 | 25.33 | 67 | 60 | 55 |
| IL52 | 1.16 | .18 | .08 | 3.55 | 8.95 | 9.66 | 1.06 | — | — | 1.15 | 28.27 | 67 | 61.5 | 56 |
| IL55 | 1.20 | .18 | .10 | 3.54 | 6.08 | 12.35 | 1.09 | — | — | 1.18 | 30.07 | 67 | 60.5 | 55 |
| IL56 | 1.18 | .16 | .09 | 3.41 | 8.69 | 12.41 | 1.05 | — | — | 1.17 | 33.51 | 67 | 58.5 | 55.5 |
| IL57 | 1.23 | .29 | .18 | 3.96 | 6.34 | 9.89 | 1.15 | — | 1.00 | 1.20 | 26.12 | 68 | 61.5 | 58.5 |
| IL58 | 1.27 | .29 | .19 | 3.83 | 6.45 | 9.66 | .88 | .79 | — | 1.29 | 25.77 | 68 | 60 | 56.5 |
| IL59 | 1.23 | .23 | .16 | 3.86 | 6.43 | 9.47 | .87 | 1.53 | — | 1.26 | 25.37 | 67 | 57.5 | 55.5 |
| CPM M42 | 1.09 | .27 | .17 | 3.74 | 1.69 | 9.22 | 1.10 | — | 7.72 | 1.07 | 20.13 | 67 | 61 | 58.5 |

*Austenitized at 2175° F./4 min., OQ, tempered at 1025° F./2 + 2 + 2 hr.

Figure 4:
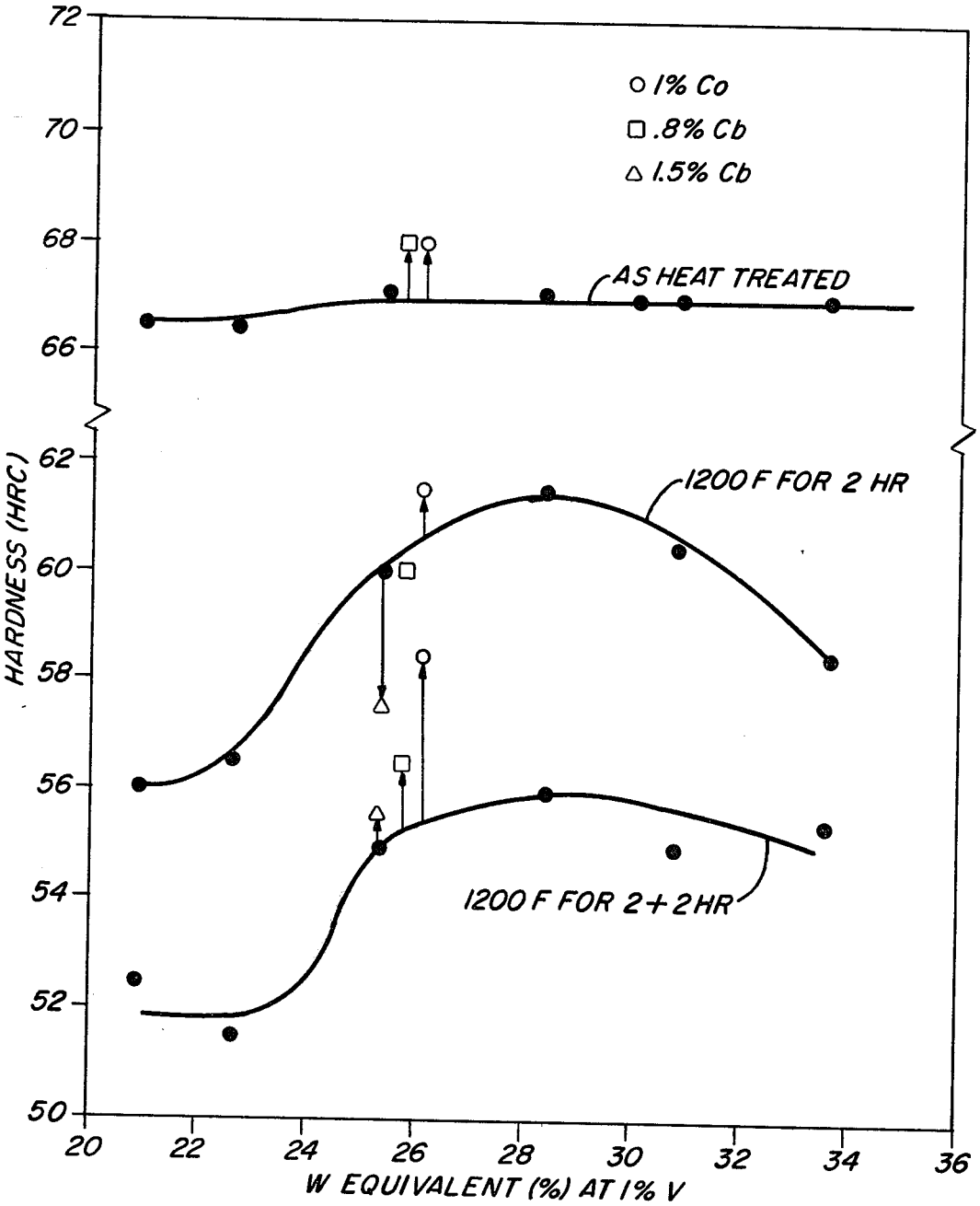
FIG. 4 is a graph showing hardnesses achieved with an alloy having a relatively low vanadium content (~1% V) but with the tungsten equivalent in accordance with the instant invention.

The data in Table II and FIG. 4 show that the tungsten equivalency limit of 22 to 29%, in accordance with the invention, is critical from the standpoint of hardness retention even at lower vanadium contents of about 0.8%. More specifically, with steels IL51 and IL52 vanadium is at approximately 1%; nevertheless, the effect with regard to hardness retention after elevated temperature exposure of having a tungsten equivalent within the limits of the invention is demonstrated. Tungsten equivalency above the limits of the invention, namely about 29%, imparts no significant benefit to hardness retention and adds to the cost of the alloy. The presence of vanadium within the limits of the invention is necessary, of course, from the standpoint of providing the alloy with the necessary wear resistance. Another element which forms a similar hard carbide and may impart wear resistance to the alloy of this invention is columbium. The addition of columbium to the alloy of this invention can be made as a substitute in part for vanadium with a benefit to the attainable hardness and hardness retention as shown in FIG. 4. The alloy of this invention may be further modified by relatively small additions of cobalt to its composition to enhance the attainable hardness and hardness retention characteristics. As an example, the addition of 1% cobalt to an alloy of 26.12% tungsten equivalency, namely alloy IL57, resulted in about a 3 HRC point increase in hardness retention after a 1200° F. for 2+2-hour exposure as shown in FIG. 4.

In view of the high carbide content of the alloy of the invention, it is necessary to have these carbides small, homogeneous and uniformly dispersed within the steel matrix. Otherwise, the alloy will not have the toughness required for use in high-speed cutting applications. Consequently, the alloy is produced by powder metallurgy techniques. Preferably, the alloy is produced by the well known technique of gas atomizing a molten stream of the alloy to from a particle charge of the alloy, which is rapidly quenched. This particle charge is then densified by any of the well known powder metallurgy techniques for this purpose, such as hot isostatic pressing.

We claim:

1. A powder-metallurgy produced, cobalt-free vanadium-containing, tungsten-type high-speed steel consisting essentially of, in weight percent, carbon minimum 0.60%+0.20×percent vanadium+0.13×percent columbium and maximum 1.2%+0.20×percent vanadium+0.13×percent columbium, manganese 1.25 max., silicon 1.25 max., chromium 3 to 5, vanadium+columbium 0.8 to 6 with columbium not exceeding 4%, and balance iron, said steel being further characterized by a tungsten equivalent of 22 to 29% and an attainable hardness of at least 67 $R_c$ when austenitized and triple tempered at 1025° F.

2. A powder-metallurgy produced, vanadium-containing, tungsten-type high-speed steel consisting essentially of, in weight percent, carbon minimum0.60%+0.20×percent vanadium+0.13×percent columbium and maximum1.2%+0.20×percent vanadium+0.13×percent columbium, manganese 1.25 max., silicon 1.25 max., chromium 3 to 5, vanadium+columbium 0.8 to 6 with columbium not exceeding 4%, up to 3% cobalt, and balance iron, said steel being further characterized by a tungsten equivalent of 22 to 29% and an attainable hardness of at least 67 $R_c$ when austenitized and triple tempered at 1025° F.

3. A powder-metallurgy produced, cobalt-free vanadium-containing, tungsten-type high-speed steel consisting essentially of, in weight percent, carbon minimum0.60%+0.20×percent vanadium+0.13×percent columbium and maximum1.2%+0.20×percent vanadium+0.13×percent columbium, manganese 1.25 max., silicon 1.25 max., chromium 3 to 5, vanadium plus columbium 3 to 6 with columbium not exceeding 4%, and balance iron, said steel being further characterized by a tungsten equivalent of 22 to 29% and an attainable hardness of at least 67 $R_c$ when austenitized and triple tempered at 1025° F.

4. A powder-metallurgy produced, vanadium-containing, tungsten-type high-speed steel consisting essentially of, in weight percent, carbon minimum0.60%+0.20×percent vanadium+0.13×percent columbium and maximum1.2%+0.20×percent vanadium+0.13×percent columbium, manganese 1.25 max., silicon 1.25 max., chromium 3 to 5, vanadium plus columbium 3 to 6 with columbium not exceeding 4%, up to 3% cobalt, and balance iron, said steel being further characterized by a tungsten equivalent of 22 to 29% and an attainable hardness of at least 67 $R_c$ when austenitized and triple tempered at 1025° F.

5. A powder-metallurgy produced, colbalt-free vanadium-containing, tungsten-type high-speed steel consisting essentially of, in weight percent, carbon minimum0.60+0.20×percent vanadium+0.13×percent columbium and maximum1.2%+0.20×percent vanadium+0.13 percent columbium, manganese 1.25 max., silicon 1.25 max., chromium 3 to 5, vanadium+columbium 0.8 to 6 with columbium not exceeding 4%, and balance iron, said steel being further characterized by having a tungsten equivalent of 24 to 27% and an attainable hardness of at least 67 $R_c$ when austenitized and triple tempered at 1025° F.

6. A powder-metallurgy produced, vanadium-containing, tungsten-type high-speed steel consisting essentially of, in weight percent, carbon minimum0.60+0.20×percent vanadium+0.13×percent columbium and maximum1.2%+0.20×percent vanadium+0.13 percent columbium, manganese 1.25 max., silicon 1.25 max., chromium 3 to 5, vanadium+columbium 0.8 to 6 with columbium not exceeding 4%, up to 3% cobalt, and balance iron, said steel being further characterized by having a tungsten equivalent of 24 to 27% and an attainable hardness of at least 67 $R_c$ when austenitized and triple tempered at 1025° F.

* * * * *